US006250269B1

(12) United States Patent
Kawasaki

(10) Patent No.: US 6,250,269 B1
(45) Date of Patent: Jun. 26, 2001

(54) ARRANGEMENT FOR SUPPORTING A ROCKER SHAFT IN AN ENGINE

(75) Inventor: Naoki Kawasaki, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/537,219

(22) Filed: Mar. 29, 2000

(30) Foreign Application Priority Data

Mar. 30, 1999 (JP) ..... 11-090217

(51) Int. Cl.[7] ..... F02F 1/24
(52) U.S. Cl. ..... 123/90.39; 123/90.27
(58) Field of Search ..... 123/90.27, 90.39, 123/90.4, 90.41, 90.44, 90.45; 74/519, 559

(56) References Cited

U.S. PATENT DOCUMENTS 4,086,887 * 5/1978 Schoonover et al. ..... 123/90.39
4,402,284 * 9/1983 Honma ..... 123/90.39
4,537,166 * 8/1985 Kimura et al. ..... 123/90.36
5,339,778 * 8/1994 Reckzugel et al. ..... 123/193.5
5,363,818 * 11/1994 Iwata et al. ..... 123/90.16
5,605,077 * 2/1997 Tsunoda et al. ..... 74/567

FOREIGN PATENT DOCUMENTS 8-100700 4/1996 (JP) .

* cited by examiner

*Primary Examiner*—Weilun Lo
(74) *Attorney, Agent, or Firm*—Finnegan, Henderson, Farabow, Garrett & Dunner, L.L.P.

(57) ABSTRACT

An arrangement is provided for supporting a rocker shaft in an engine so as to allow installation of the rocker shaft without incurring high costs, and, thereby, using a simple arrangement. An engine is equipped with valve-moving devices such as a cam shaft 21 inside a cylinder head 8, intake and exhaust valves, intake and exhaust cams 24 and 25, intake and exhaust rocker arms, a rocker shaft 28 which supports these rocker arms with freedom to rotate, and the like, and wherein bearing bosses 31*a* to 31*d* for supporting the cam shaft 21 are formed inside the cylinder head 8, flat seats 50 are formed on the bearing bosses 31*a* to 31*d*, and flat seats 51 are formed on the rocker shaft 28, and the rocker shaft 28 is fitted on the bearing bosses 31*a* to 31*d* with the two eats 50 and 51 matched against each other.

10 Claims, 7 Drawing Sheets

ARRANGEMENT FOR SUPPORTING A ROCKER SHAFT IN AN ENGINE

BACKGROUND OF THE INVENTION

1. Field of the Invention

The present invention relates to an arrangement for supporting a rocker shaft in an engine.

2. Description of the Related Art

Four-stroke engines are provided with a valve-moving device within the cylinder head. The main component members in such valve-moving devices are a cam shaft, which rotates in motion with a crank shaft, an intake valve and an exhaust valve, valve-moving intake and exhaust cams provided on the cam shaft, intake and exhaust rocker arms, which transmit the rotational motion of the intake and exhaust cams to the two valves, a rocker shaft supporting the rocker arms with freedom of rotation, and the like.

A known method of supporting the rocker shaft within the cylinder head is, by way of example, to provide bearing bosses, which support the cam shaft with adequate excess materials, to run to an insertion hole, which is parallel with the cam shaft through the excess material, and to pass through a rocker shaft through this run-through hole.

In addition, normally a single rocker shaft is used for both the intake and the exhaust rocker arms.

Rocker shafts require an extremely high degree of precision in cases where a run-through hole for the rocker shaft is machined into the excess material of a bearing boss since any discrepancy in positioning has a major effect on the performance of the valve-moving device, not least in that it produces variations in the valve timing.

However, high-precision machining is undesirable since it requires special equipment and the machining itself entails costs.

Further, providing a bearing boss with excess material for supporting a rocker shaft also produces problems in that it causes increased weight, and pores are liable to occur during casting if a large amount of excess material is formed.

Meanwhile, if a single rocker shaft is used for both the intake and the exhaust rocker arms, there are limits on factors such as the position in which the valves are installed, and the degree of freedom in the layout of the valve-moving device is reduced.

SUMMARY OF THE INVENTION

The advantages and purposes of the invention will be set forth in part in the description which follows, and in part will be obvious from the description, or may be learned by practice of the invention. Moreover, the advantages and purposes of the invention will be realized and attained by means of the elements and combinations particularly pointed out in the appended claims.

The present invention has taken the above situation into account and aims to provide an arrangement for supporting a rocker shaft in an engine allowing installation of the rocker shaft without incurring high costs, while employing a simple arrangement.

Another exemplary aim of the present invention is to provide an arrangement for supporting a rocker shaft in an engine whereby the degree of the freedom in the layout of the valve-moving device is increased.

Yet another exemplary aim of the present invention is to provide an arrangement for supporting a rocker shaft in an engine whereby rocker shaft positioning is facilitated.

In order to overcome the exemplary problems discussed above as well as to provide additional advantages, the arrangement for supporting a rocker shaft in an engine according to the present invention involves an engine equipped with valve-moving devices such as a cam shaft inside a cylinder head, intake and exhaust valves, intake and exhaust cams, intake and exhaust rocker arms, rocker shafts, which support these rocker arms with freedom of rotation, and the like, wherein bearing bosses for supporting the cam shaft are formed inside the cylinder head, flat seats are formed on the bearing bosses, and flat seats are formed on the rocker shafts, and the rocker shafts are fitted on the bearing bosses with the flat seats matched against each other.

Further, in order to overcome the exemplary problems discussed above, the rocker shafts are fixed on the bearing bosses via a bracket, and a thrust-receiving part is integrally formed on the bracket, and a spacer spring is installed between this thrust-receiving part and the supported parts of the rocker arms such that the rocker arms are held on the rocker shafts.

Also, in order to further overcome the problems discussed above and provide further advantages, the rocker shafts are provided, respectively one apiece, in the intake rocker arm and exhaust rocker arm.

Furthermore, in order to overcome the problems discussed above and provide still other advantages, the above-mentioned bracket is integrated in such a way that it extends across both the intake rocker shaft and the exhaust rocker shaft.

In addition, in order to overcome the problems discussed above and provide additional advantages, knock pins are installed between the rocker shafts and the bearing bosses when fitting the rocker shafts.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION

Reference will now be made in detail to the present preferred embodiments of the invention illustrated in the accompanying drawings. Wherever possible, the same reference numbers are used throughout the drawings to refer to the same or like parts.

Figure 1:
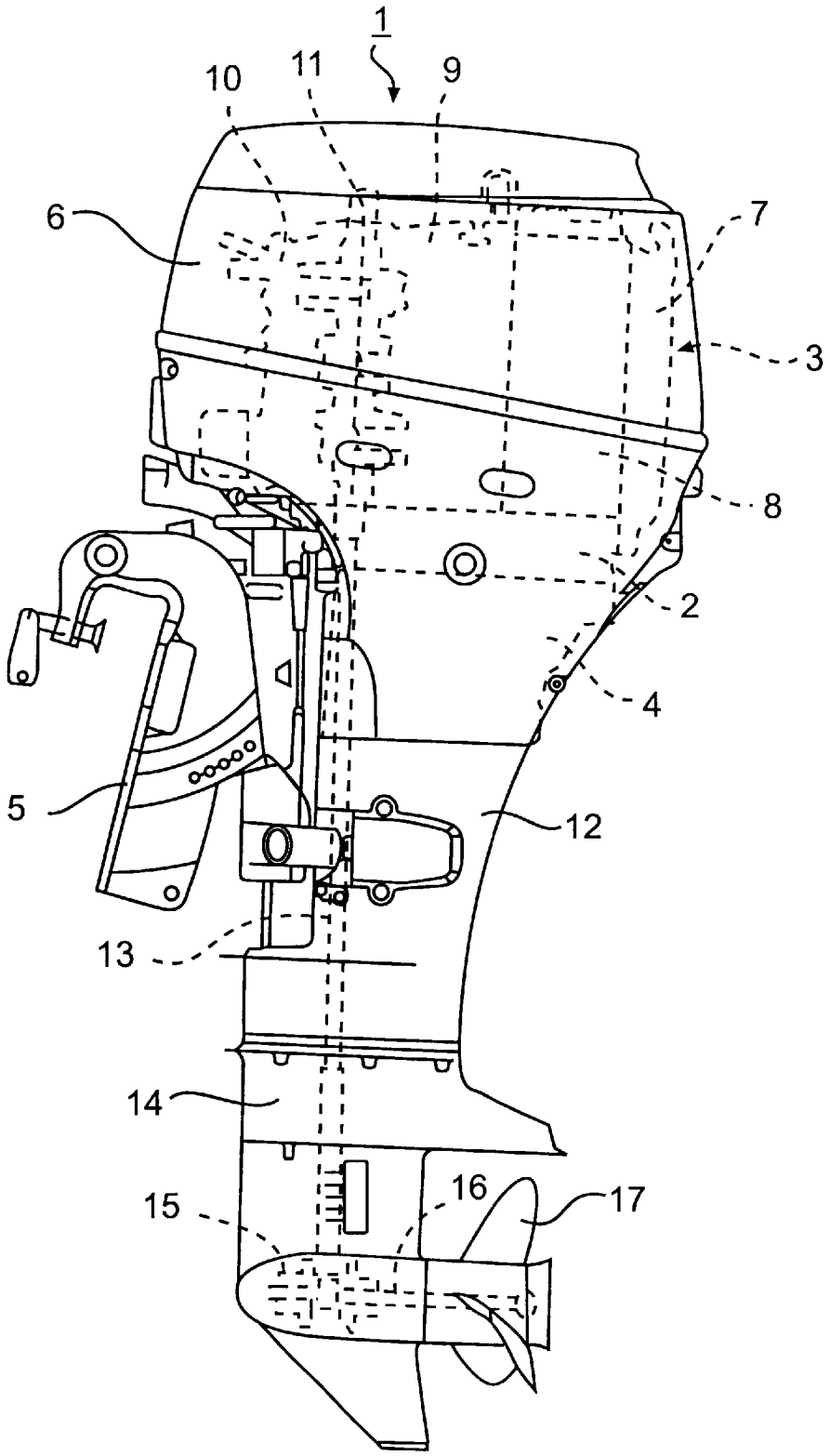
FIG. 1 is a left-side view of an outboard motor illustrating one embodiment of an arrangement for supporting rocker shafts of an engine according to the present invention.

FIG. 1 is a left-side view of an outboard motor equipped with an engine of the present invention. As shown in FIG. 1, the outboard motor 1 is equipped with an engine holder 2, and an engine 3 is installed above this engine holder 2. Further, an oil pan 4 is installed below the engine holder 2 and, by way of example, a bracket 5 is attached to the engine holder 2, and the outboard motor 1 is installed via this bracket 5 on the transom of a boat, which is not depicted. Further, the area around the engine 3 is covered by means of an outboard motor cover 6.

Figure 2:
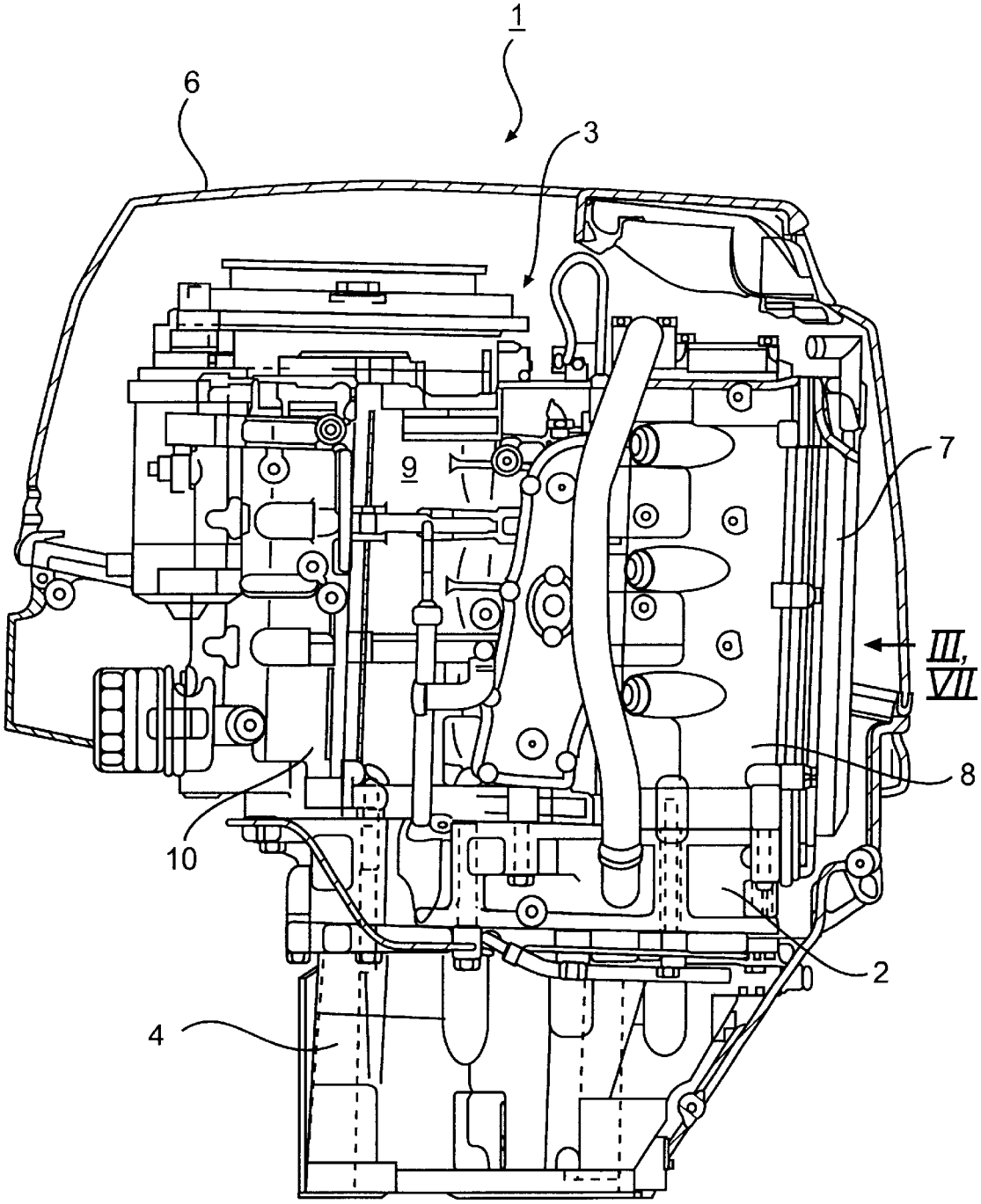
FIG. 2 is an enlarged side view of the engine portion.

FIG. 2 is an enlarged side view of the engine 3 portion, in which only the outboard motor cover 6 is illustrated in cross section. As shown in FIGS. 1–2, the engine 3 mounted in this outboard motor 1 is a water-cooled, four-stroke, three cylinder engine comprising a combination of, by way of example, a cylinder head cover 7, cylinder head 8, cylinder block 9, crank case 10 and the like, and the cylinders (not depicted) are provided in a line in the top-to-bottom direction. It will be noted that, for the sake of convenience, the cylinder installed in the top-most part in the present embodiments is designated the first cylinder, and this is followed, progressing downwards, by the second and third cylinders.

The cylinder block 9 is installed to the rear (i.e., to the right) of the crank case 10 installed to the left in FIG. 1 and FIG. 2, the front-most part of the engine 3. Further, the cylinder head 8 is installed to the rear of the cylinder block 9. Also, a rear opening of the cylinder head 8 is covered by the cylinder head cover 7. In addition, the engine 3 is an engine of the vertical type (see FIG. 1) in which a crank shaft 11 is installed approximately perpendicularly inside the part where the crank case 10 and the cylinder block 9 meet.

As shown in FIG. 1, a shaft housing 12 is installed on the lower part of the oil pan 4. A drive shaft 13 is installed approximately perpendicularly inside the engine holder 2, oil pan 4 and shaft housing 12, and its upper end part is connected to the lower end part of the crank shaft 11. The drive shaft 13 is constituted in such a way that it extends downwards through the inside of the shaft housing 12, and drives a propeller 17 via a bevel gear 15 and propeller shaft 16 inside a gear case 14 provided on the lower part of the shaft housing 12.

Figure 3:
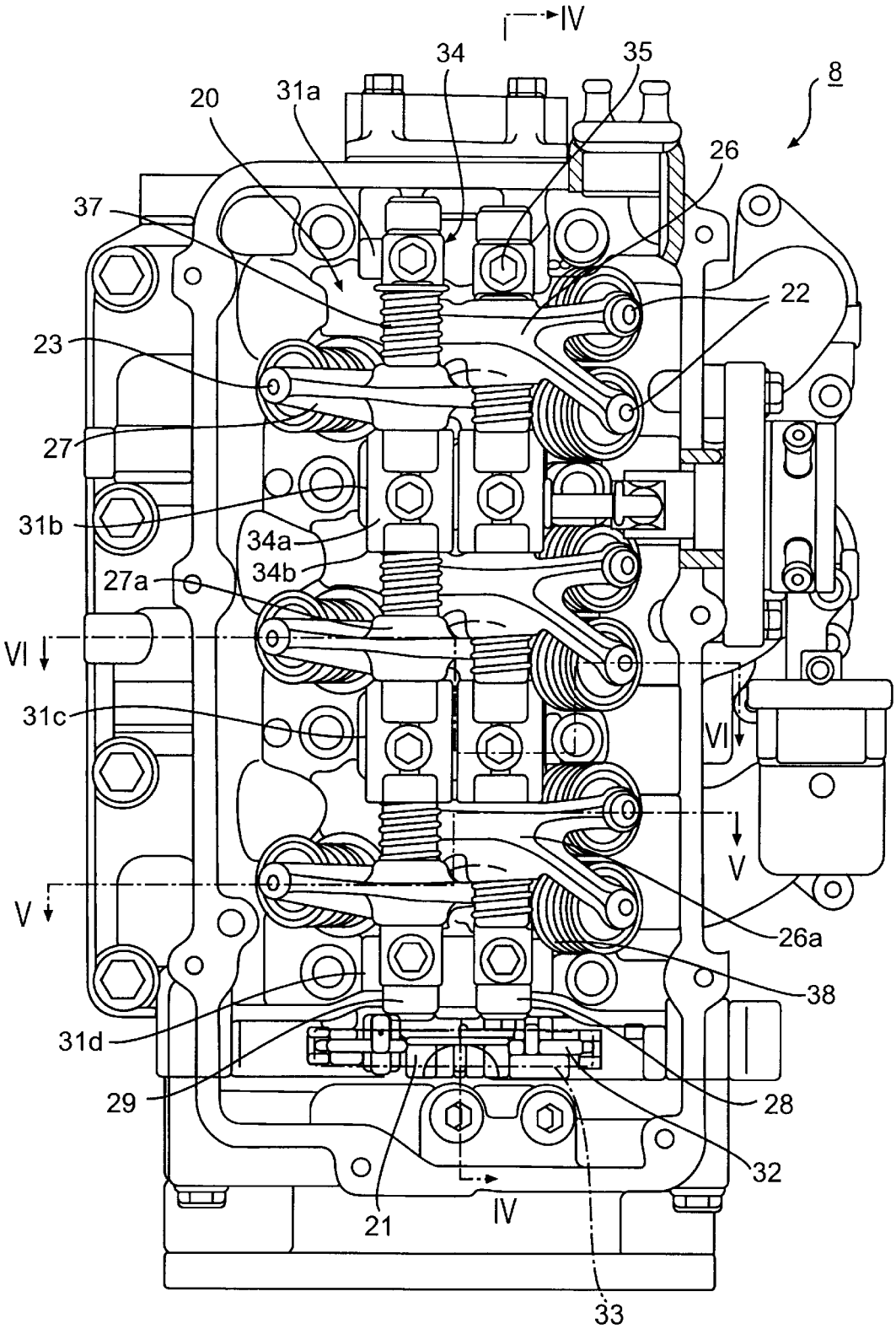
FIG. 3 is a view, which is taken from the arrow III of the engine shown in FIG. 2, illustrating a first embodiment of the present invention.
Figure 4:
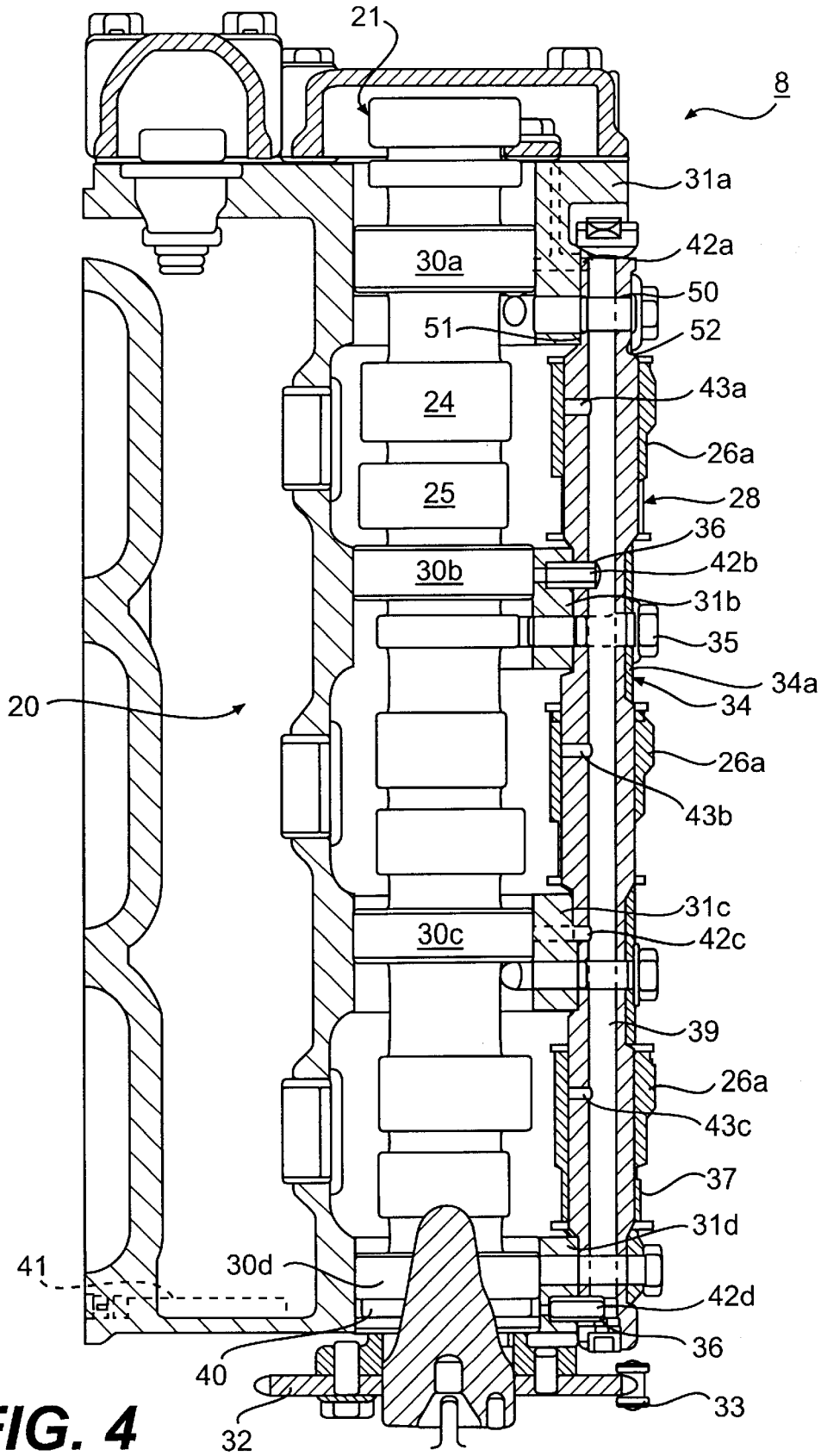
FIG. 4 is a cross-sectional view taken along the lines IV—IV of FIG. 3.
Figure 5:
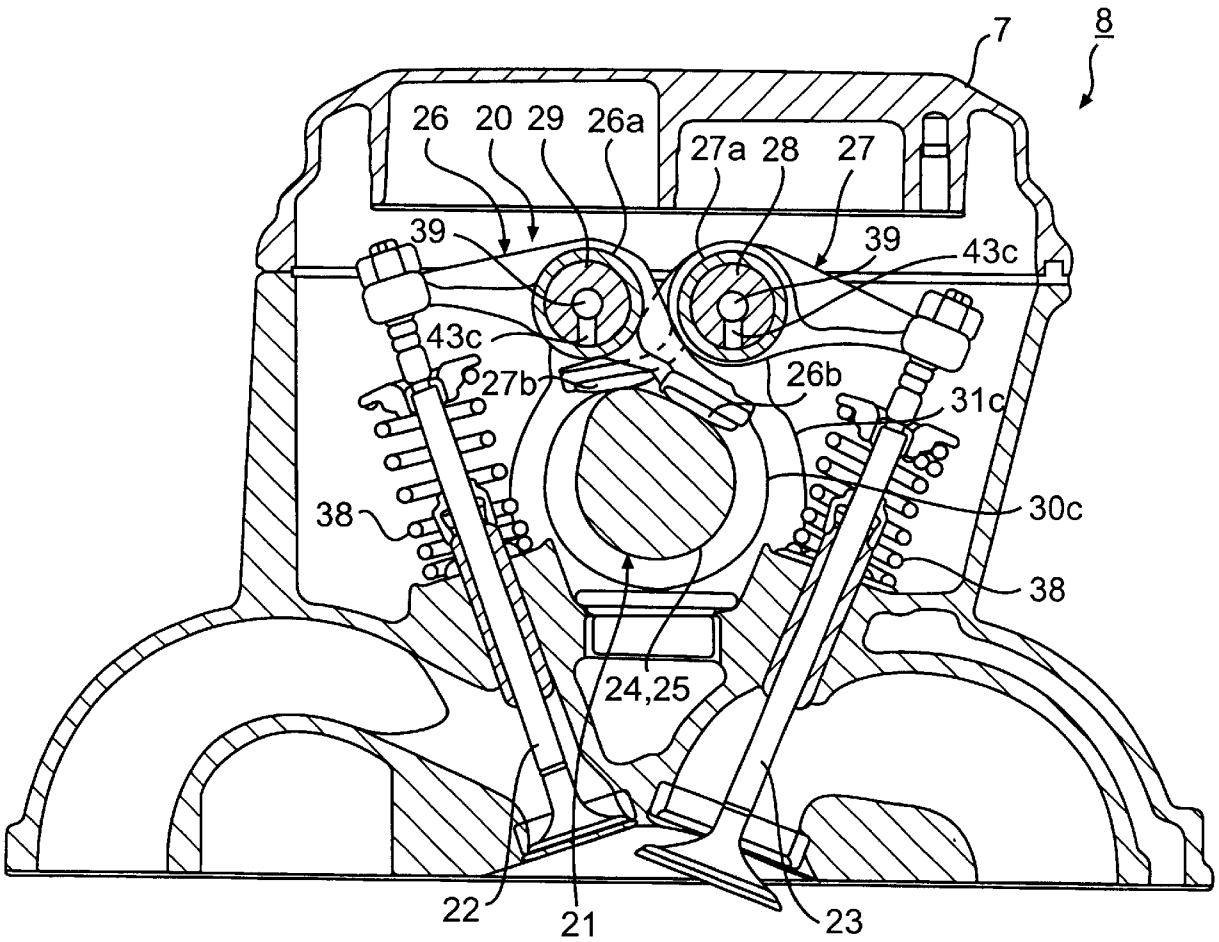
FIG. 5 is a cross-section view taken along the lines V—V of FIG. 3.
Figure 6:
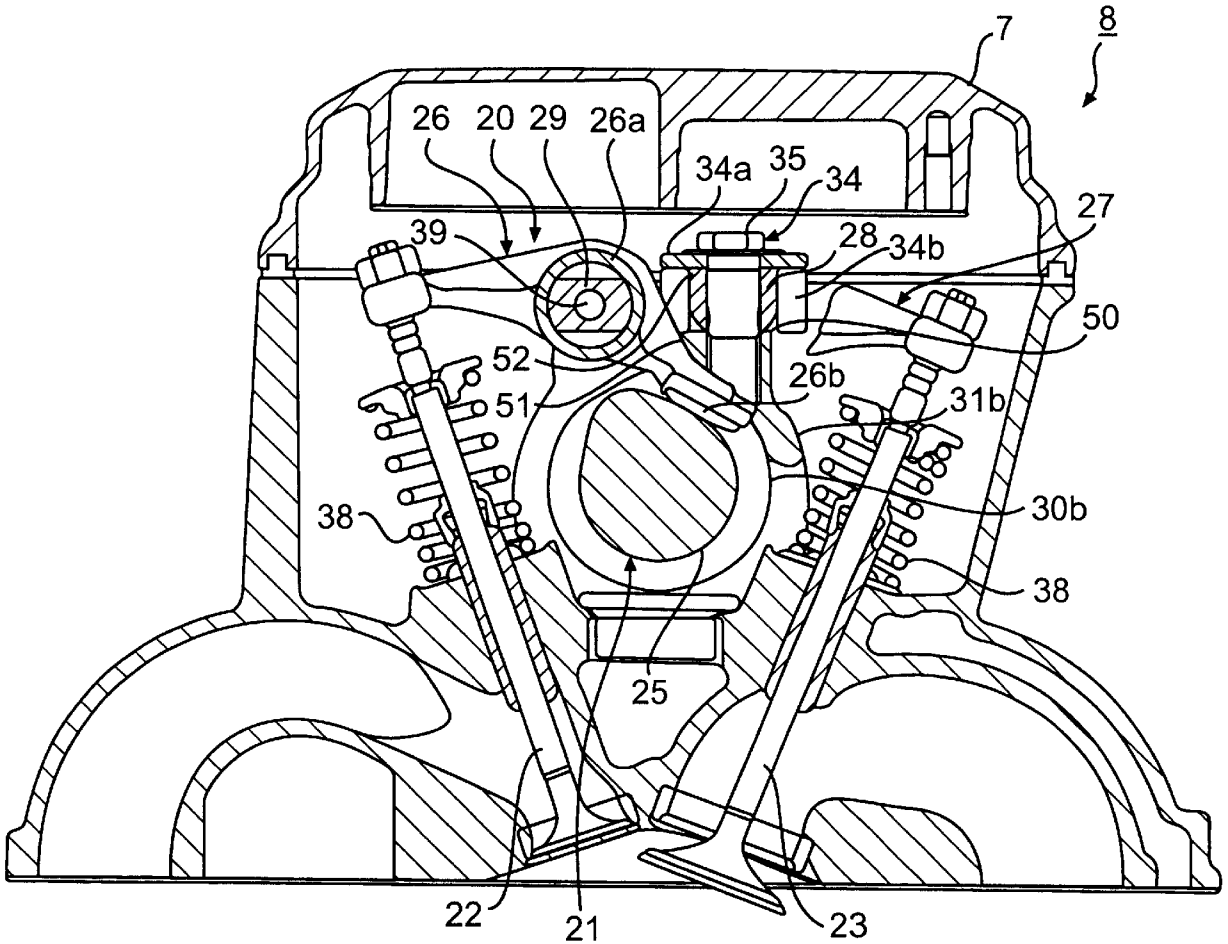
FIG. 6 is a cross section along the lines VI—VI of FIG. 3.

FIG. 3, which is a view taken from the arrow III of the engine 3 illustrated in FIG. 2, provides a rear view of the cylinder head 8 in the state following the removal of the cylinder head cover 7 of a first embodiment of the present invention. Further, FIG. 4 is a cross section along the lines IV—IV of FIG. 3. Moreover, FIG. 5 is a cross section along the lines V—V of FIG. 3. Finally, FIG. 6 is a cross sectional view along the lines VI—VI of FIG. 3.

As shown in FIGS. 3–6, a valve-moving device 20 is provided in the cylinder head 8 of the engine 3. The valve-moving device 20 has as its main constituent members a cam shaft 21 installed in parallel with the crank shaft 11, an intake valve and exhaust valve 22 and 23, intake and exhaust cams 24 and 25 for valve movement provided on the cam shaft 21, rocker arms 26 and 27 for intake and exhaust which transmit the rotation of these intake and exhaust cams 24 and 25 to the two valves 22 and 23, rocker shafts 28 and 29 for intake and exhaust, which support these rocker arms 26 and 27 with freedom to rotate, and the like.

The valve-moving device 20 of the engine 3 shown in the present embodiment is equipped with two intake valves 22 and 22 and one exhaust valve 23 for each cylinder, and the cam shaft 21 is equipped with a cam train comprising an intake cam 24 and exhaust cam 25 for each cylinder, corresponding to these valves 22, 22 and 23. Further, in the present embodiment, the two intake valves 22 and 22 are operated so as to open and close by means of a single intake rocker arm 26. Also, the rocker shafts 28 and 29 are provided, respectively one apiece, in the intake rocker arm 26 and exhaust rocker arm 27.

On the cam shaft 21, bearing journals 30*a* to 30*d* are formed at both end parts of the cam shaft 21, and between the cam trains for the first and second cylinders, and between the cam trains for the second and third cylinders. These bearing journals 30*a* to 30*d* are supported with freedom to rotate by means of cylindrical bearing bosses 31*a* to 31*d* integrally formed in the cylinder head 8. Further, the bearing bosses 31*a* to 31*d* are installed in positions corresponding to each of the bearing journals 30*a* to 30*d*, which is to say between the cylinders and the top and bottom ends of the cylinder head 8. It will be noted that a cam-driven gear 32 is provided in the lower end part of the cam shaft 21, and, although not depicted in detail, the rotation of the crank shaft 11 is transmitted via a timing chain 33.

The intake rocker shaft 28 and the exhaust rocker shaft 29 are installed in parallel with each other on the bearing bosses 31*a* to 31*d*, and in parallel with the cam shaft 21 as well. Flat seats 50, which are alternatively referred to as first flat seats 50, are formed on the surfaces of the bearing bosses 31*a* to 31*d* where the rocker shafts 28 and 29 are fitted, and flat seats 51, which are alternatively referred to as second flat seats 51, are also formed on the rocker shafts 28 and 29 facing the flat seats 50. In addition, the two rocker shafts 28 and 29 are respectively fixed on the bearing bosses 31*a* to 31*d*, for example by bolts 35 via brackets 34.

Such brackets 34 are made of sheet metal, for example, and are integrally equipped with washer parts 34*a* placed on flat seats 52 provided on the rocker shafts 28 and 29 on the side opposite the flat seat 51 on the side of the bearing bosses 31*a* to 31*d*, and with thrust-receiving parts 34*b* extending in the diametric direction of the rocker shafts 28 and 29 in such a way as to straddle both sides of the rocker shafts 28 and 29 from the ends of the washers 34*a* in the axial direction of the rocker shafts 28 and 29.

Each of the rocker shafts 28 and 29 is positioned on the bearing bosses 31*b* and 31*d* between the first and second cylinders and below the third cylinder, by way of example, by the use of hollow positioning knock pins 36. On the rocker shafts 28 and 29, supported parts 26*a* and 27*a* of the rocker arms 26 and 27 are axially supported with freedom to rotate, and a spacer spring 37 is installed between the thrust-receiving part 34*b* of the bracket 34 fixing the rocker shafts 28 and 29 and the supported parts 26*a* and 27*a* of the rocker arms 26 and 27, thereby positioning the rocker arms 26 and 27 on the rocker shafts 28 and 29.

One end of each of the rocker arms 26 and 27 makes contact with the head of each of the valves 22 and 23. In addition, the cam follower surfaces 26*b* and 27*b* formed at the other ends of the rocker arms 26 and 27 are pressed up by the intake and exhaust cams 24 and 25 due to the rotation of the cam shaft 21, and, thus, the valves 22 and 23 are opened and closed. It will be noted that the valves 22 and 23 are normally held in the closed position by means of the valve springs 38.

On the inside of each of the rocker shafts 28 and 29 is formed an oil gallery 39 extending the axial directions thereof. Further, an oil channel 40 is formed in the circumferential direction on the outer circumferential surface of the bearing journal 30*d* provided at the lower end of the cam shaft 21, an oil introduction path 41, which opens (not depicted) towards the oil channel 40 is provided on the inner circumferential surface of the bearing 31*d* supporting the bearing journal 30*d*, and lubricating oil forwarded under pressure by means of an oil pump, which is not depicted, is introduced into the oil channel 40.

Holes for the knock pins 36 formed in the bearing boss 31*d* below the third cylinder open towards the inner circumferential surface of the bearing boss 31*d* facing the oil channel 40, the hollow knock pins 36 constitute oil through-paths 42*d*, and conduct lubricating oil, which has been introduced into the oil channel 40, into the oil galleries 39 formed in the rocker shafts 28 and 29. In addition, oil through-paths 42*a* to 42*c* are formed towards the inner circumferential surfaces of the remaining bearing bosses 31*a* to 31*c* from the oil gallery 39, and lubricate the sliding-contact surfaces of the bearing bosses 31*a* to 31*d* and bearing journals 30*a* to 30*d*. It will be noted that the oil through-path 42*b* formed in the bearing boss 31*b* between the first and second cylinders also performs the function of a hole for the knock pin 36, in the same way as the oil through-path 42*d* of the bearing boss 31*d* below the third cylinder. Also, oil through-paths 43*a* to 43*c* are formed from the oil galleries 39 towards the sliding contact surfaces of the supported parts 26*a* and 27*a* of the rocker arms 26 and 27.

Figure 7:
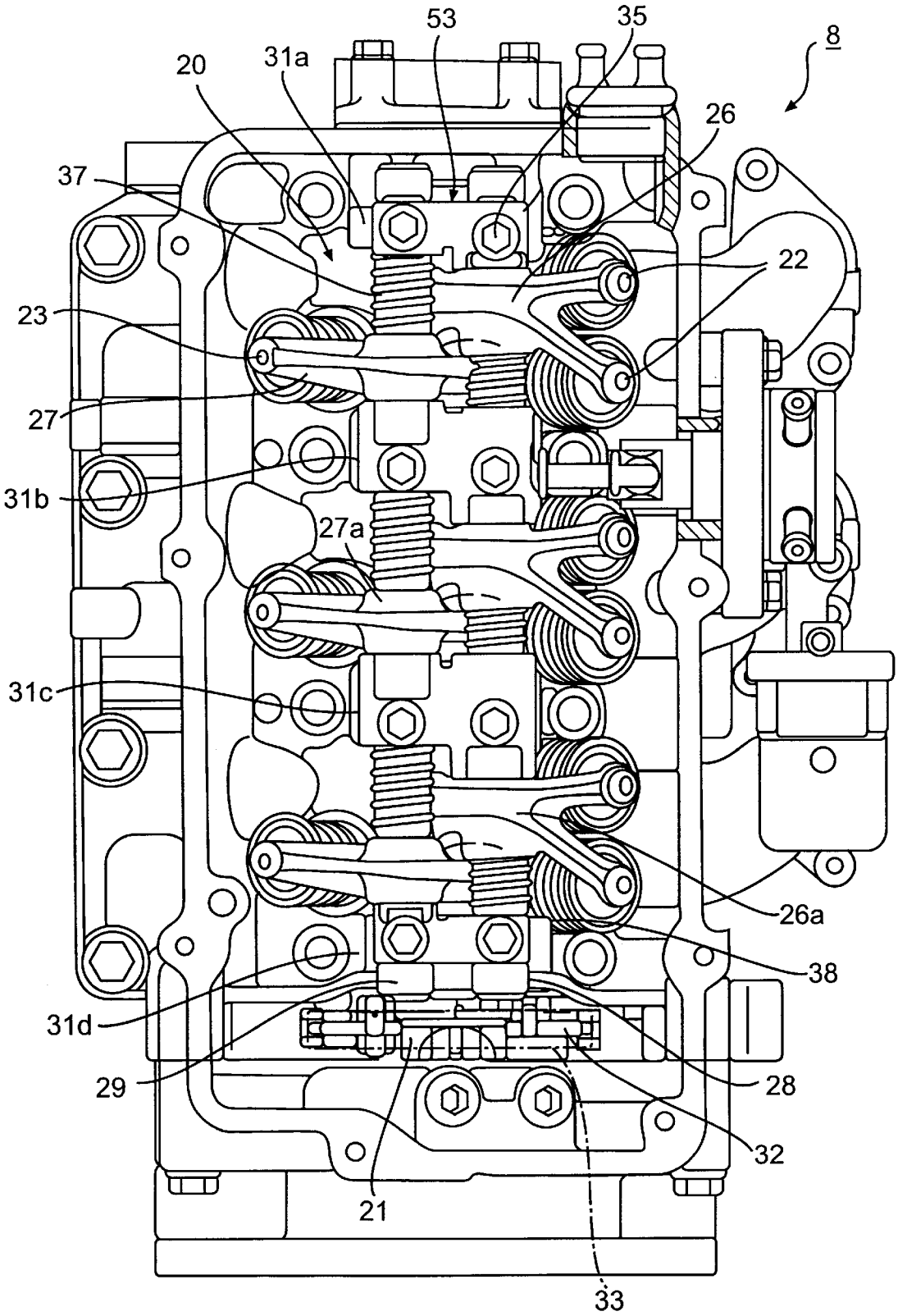
FIG. 7 is a view, which is taken from the arrow VII of the engine shown in FIG. 2, illustrating a second embodiment of the present invention.

FIG. 7, which is a view taken from the arrow VII of the engine 3 shown in FIG. 2, provides a rear view of the cylinder head 8 in the state following removal of the cylinder head cover 7 of a second embodiment of the present invention. It should be noted that identical references have been described to constitute members, which are shared with the arrangement shown in the first embodiment. In the second embodiment, brackets 53, which fix the rocker shafts 28 and 29 onto bearing bosses 31*a* to 31*d*, are integrated in such a way that they extend across both the intake rocker shafts 28 and 29 and the exhaust rocker shafts 28 and 29.

The operation of the present embodiments will now be described.

By forming the flat seats 50 and 51 on the bearing bosses 31*a* to 31*d* of the cam shaft 21 and on both the rocker shafts 28 and 29, and by matching the two flat seats 50 and 51 with each-other, stability while fitting the rocker shafts 28 and 29 can be ensured without incurring costs. Further, if knock pins 36 are used while fitting the rocker shafts 28 and 29, the rocker shafts 28 and 29 can be easily and accurately positioned even without high processing precision, the performance of the valve-moving device 20 can be kept high, for example with improvements in the reliability of valve timing, and the weight of the cylinder head 8 as a whole can be reduced.

Also, by forming the thrust-receiving part 34*b* integrally with the sheet-metal bracket 34 for fixing the rocker shafts 28 and 29, and by installing the spacer spring 37 between the thrust-receiving part 34*b* and the supported parts 26*a* and 27*a* of the rocker arms 26 and 27, the rocker arms 26 and 27 can be positioned and held on the rocker shafts 28 and 29 using a simple arrangement and inexpensive and lightweight parts.

Furthermore, by providing the rocker shafts 28 and 29, respectively one apiece, in the intake rocker arm 26 and the exhaust rocker arm 27, the degree of freedom in the layout of the valve-moving device 20 is increased, and the engine 3 can be enhanced in performance and reduced in scale as compared with cases where a single rocker shaft is shared by both rocker arms.

In addition, if a bracket 53, which fixes the rocker shafts 28 and 29 on bearing bosses 31*a* to 31*d*, is integrated in such a way that it extends across both the intake rocker shaft 28 and the exhaust rocker shaft 29, the number of parts can be reduced and the rigidity of the valve-moving device 20 is also increased.

As described above, when an arrangement for rocker shaft support in an engine according to the present invention is employed, the rocker shafts can be installed without incurring costs, and stability during installation of the rocker shaft is adequately ensured because, in an engine equipped with valve-moving devices such as a cam shaft inside a cylinder head, intake and exhaust valves, intake and exhaust cams, intake and exhaust rocker arms, rocker shafts, which support these rocker arms with freedom of rotation, and the like, bearing bosses for supporting the cam shaft are formed inside the cylinder head, flat seats are formed on the bearing bosses, and flat seats are formed on the rocker shafts, and the rocker shafts are fitted on the bearing bosses with the two flat seats matched against each other.

Further, because the rocker shafts are fixed on the bearing bosses via a bracket, and a thrust-receiving part is integrally formed on the bracket, and a spacer spring is installed between this thrust-receiving part and the supported parts of the rocker arms such that the rocker arms are held on the rocker shafts, it follows that the rocker arms can be positioned on the rocker shafts using a simple arrangement.

Also, because the rocker shafts are provided, respectively one apiece, in the intake rocker arm and exhaust rocker arm, it follows that the degree of freedom in the layout of the valve-moving device is increased.

Furthermore, because the abovementioned bracket is integrated in such a way that it extends across both the intake rocker shaft and the exhaust rocker shaft, it follows that rigidity of the valve-moving device is increased, and the number of parts can also be reduced.

In addition, because knock pins are installed between the abovementioned rocker shafts and the abovementioned bearing bosses when fitting the rocker shafts, it follows that the rocker shafts can be positioned accurately and easily, and the performance of the valve-moving device is improved, and, because formation of the flat seat does not require high precision, it follows that costs are reduced.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

What is claimed is:

1. An arrangement for supporting at least one rocker shaft in an engine equipped with valve-moving devices including a cam shaft inside a cylinder head, intake and exhaust valves, intake and exhaust cams, and intake and exhaust rocker arms rotatably supported by the at least one rocker shaft, comprising:

at least one bearing boss formed inside the cylinder head for supporting the cam shaft;

at least one first flat seat formed on the at least one bearing boss;

at least one second flat seat formed on the at least one rocker shaft; and wherein the at least one rocker shaft is fitted on the at least one bearing boss such that the first and second flat seats are matched against each other.

2. An arrangement for supporting a rocker shaft in an engine as claimed in claim 1, wherein the at least one rocker shaft is fixed on the at least one bearing boss by a bracket, a thrust-receiving part is integrally formed on the bracket, and a spacer spring is placed between the thrust-receiving part and at least one supported part of the at least one rocker arm such that the at least one rocker arm is positioned on the at least one rocker shaft.

3. An arrangement for supporting a rocker shaft in an engine as claimed in claim 1, wherein, the at least one rocker shaft comprises an intake rocker shaft and an exhaust rocker shaft each respectively supporting the intake rocker arm and the exhaust rocker arm, and the at least one bearing boss comprises a plurality of bearing bosses.

4. An arrangement for supporting a rocker shaft in an engine as claimed in claim 2, wherein, and the at least one rocker shaft comprises an intake rocker shaft and an exhaust rocker shaft each respectively supporting the intake rocker arm and the exhaust rocker arm, and the at least one bearing boss comprises a plurality of bearing bosses.

5. An arrangement for supporting a rocker shaft in an engine as claimed in claim 2, wherein the bracket extends across both the intake rocker shaft and exhaust rocker shaft.

6. An arrangement for supporting a rocker shaft in an engine as claimed in claim 4, wherein the bracket extends across both the intake rocker shaft and exhaust rocker shaft.

7. An arrangement for supporting a rocker shaft in an engine as claimed in claim 1, wherein knock pins are placed between the at least one rocker shaft and the at least one bearing boss when fitting the rocker shafts.

8. An arrangement for supporting a rocker shaft in an engine as claimed in claim 2, wherein knock pins are placed between the at least one rocker shaft and the at least one bearing boss when fitting the rocker shafts.

9. An arrangement for supporting a rocker shaft in an engine as claimed in claim 3, wherein knock pins are placed between the intake and exhaust rocker shafts and the bearing bosses when fitting the rocker shafts.

10. An arrangement for supporting a rocker shaft in an engine as claimed in claim 4, wherein knock pins are placed between the intake and exhaust rocker shafts and the bearing bosses when fitting the rocker shafts.

* * * * *